US006237932B1

(12) United States Patent
Zanco et al.

(10) Patent No.: US 6,237,932 B1
(45) Date of Patent: May 29, 2001

(54) BOARD FOR GLIDING ON SNOW

(75) Inventors: Alain Zanco, Voiron; Max Mermet, Burcin; Eric Restani, Voiron; Thierry Schrobiltgen, Attignat-Oncin, all of (FR)

(73) Assignee: Skis Rossignol S.A., Voiron (FR)

( * ) Notice: Subject to any disclaimer, the term of this patent is extended or adjusted under 35 U.S.C. 154(b) by 0 days.

(21) Appl. No.: 09/326,675

(22) Filed: Jun. 7, 1999

(30) Foreign Application Priority Data

Jun. 5, 1998 (FR) ..... 98 08259

(51) Int. Cl.[7] ..... A63C 5/00
(52) U.S. Cl. ..... 280/602; 280/609
(58) Field of Search ..... 280/601, 602, 280/608, 609, 610

(56) References Cited

U.S. PATENT DOCUMENTS

| | | |
|---|---|---|
| 3,901,522 | 8/1975 | Boehm . |
| 5,232,241 | 8/1993 | Knott et al. . |

FOREIGN PATENT DOCUMENTS

| | | |
|---|---|---|
| 44 02 669 A1 | 1/1994 | (DE) . |
| 0 188 985 A1 | 7/1986 | (EP) . |
| 0 367 964 | 7/1988 | (EP) . |
| 2 599 636-A1 | 12/1987 | (FR) . |
| 2 611 518-A1 | 9/1988 | (FR) . |
| 2 615 405-A1 | 11/1988 | (FR) . |
| 2 618 344-A1 | 1/1989 | (FR) . |
| 2 648 721 | 6/1989 | (FR) . |
| 2 683 734-A1 | 5/1993 | (FR) . |

*Primary Examiner*—Richard M. Camby
(74) *Attorney, Agent, or Firm*—Ollif & Berridge, PLC

(57) ABSTRACT

A board having a lower assembly composed of a sole optionally bordered by metal edges, a central core, and an upper cover forming a shell, composed of an upper wall extended laterally by side walls whose lower corners bear on two longitudinal reinforcement elements which themselves bear on the lower assembly. This board is equipped with at least one vibration damper element which is made of viscoelastic material and is located on one side of the board and emerges visibly on this side, and lies in the region contained between a lower corner of the upper cover and the lower assembly.

19 Claims, 3 Drawing Sheets

BOARD FOR GLIDING ON SNOW

BACKGROUND OF THE INVENTION

The present invention relates to a board for gliding on snow, this gliding board consisting for example of a ski, a snowboard or a monoski, and the ski in question being for example of the alpine ski, nordic ski or cross-country ski type.

DESCRIPTION OF THE PRIOR ART

This gliding board is of the type having a lower assembly composed of a sole optionally bordered by metal edges and optionally combined with a lower reinforcing layer, a central core optionally combined with reinforcing elements, and an upper cover forming a shell, composed of an upper wall extended laterally by side walls whose lower corners bear on two longitudinal reinforcement elements which themselves bear on the lower assembly, the upper cover being optionally combined, on its inner face, with a reinforcing layer, this board being further equipped with at least one vibration damper element.

A gliding board of this type is illustrated, in the case of a ski, in document FR 2 683 734 in the name of the Applicant Company.

When moving on snow, a gliding board is subjected to vibrations generated by successive impacts against unevennesses in the surface on which it is moving. These vibrations compromise the stability of the board, its purchase on the snow, as well as the quality of its glide, and cause discomfort to the user.

It is known to attempt to eliminate, or limit, the amplitude of these vibrations by equipping gliding boards with vibration damper elements.

Thus, document EP 0 188 985 relates to a ski having a vibration damper device which consists of at least one layer of viscoelastic material fixed on the upper face of the ski and constrained by a plate with high modulus of elasticity. A damper device of this type is located at a specific position to provide maximum efficiency.

Documents FR 2 611 518 and 2 615 405 each relate to a ski of the gliding board type according to the invention, that is to say having an upper cover in the form of a shell, the lower corners of which bear on the lower assembly. In these two documents, the ski comprises a central core which, with the upper cover, delimits lateral volumes used to accommodate, over the entire length or almost the entire length of the ski, viscoelastic material having a damper function. However, such damping makes the ski fairly inert because of excessive damping.

Document FR 2 618 344 describes a ski of 15 rectangular cross section, that is to say having a lower assembly, an upper wall and side faces delimiting a volume filled with a core. Transverse holes which pass through one side face and extend over a part of the width of the core are made in the ski, these holes being filled with a damping material.

However, the damping effect is negligible because this structure does not form a barrier to the propagation of vibrations through the side faces, around the holes.

Document FR 2 599 636 relates to a ski having a central part in which recesses containing damping elements are made. These damping elements may actually extend right through the side faces of the ski.

The damping effect is in this case questionable since the positioning of the damping elements is not defined.

SUMMARY OF THE INVENTION

The object of the invention is to provide a board for gliding on snow, of the aforementioned type, which provides selective filtering of the vibrations that are transmitted between a lower ridge of the board in contact with the snow, and the upper face of the board, on which the user's foot or feet are fixed, depending on the type of board in question. This actually involves damping only the unwanted vibrations, because excessive vibration damping would lead to a lack of response from the ski.

To this end, the board for gliding on snow to which it relates comprises at least one vibration damper element which is located on one side of the board and emerges visibly on this side, and lies in the region contained between a lower corner of the upper cover and the lower assembly, this damper element constituting a direct barrier to vibrations propagating between the lower ridge of the board in contact with the snow and the upper wall of the board to which the user's feet are fixed.

When a board for gliding on snow is being used, the board is circumscribed by a lower inner ridge when a turn is being performed. The force transmitted from the lower ridge to the upper surface of the board, on which one of the user's feet, or both feet in the case of a snowboard or a monoski, is fixed, passes through the side wall of the board lying on the inside of the turn. Locating damper elements level with this side wall makes it possible to filter uncomfortable vibrations which impair good control of the board and good purchase of the board on the snow.

According to a first embodiment of this gliding board, a damper element is arranged between a lower corner of the upper cover and a longitudinal reinforcement element.

According to a first possibility in this case, the upper cover has, level with a damper element, an upward protrusion delimiting a recess for at least partial accommodation of this damper element.

According to a second possibility in this case, each longitudinal reinforcement element has, level with a damper element, a recess which is turned upward and emerges on one side of the board, and is intended for at least partial accommodation of this damper element.

It should be noted that the two possibilities envisaged above may be combined, and a damper element may be accommodated partly in a recess made in the upper cover and partly in a recess made in a reinforcing element and emerging in its upper face.

According to another embodiment of this gliding board, a damper element is arranged between a lower corner of a longitudinal reinforcement element and the lower assembly, this longitudinal reinforcement element having a recess emerging in its lower face and on one side of the board, and intended for accommodation of the damper element.

According to yet another embodiment of this gliding board, a damper element is arranged inside a longitudinal reinforcement element, in a slot passing through the entire width of the element.

According to another feature of the invention, each damper element has a length of between 50 and 300 mm.

According to one possibility, each damper element has a thickness which varies over its length. Preferably, in this case, the thickness of each damper element is a maximum in its central part and decreases in the direction of its ends.

According to another feature of the invention, the thickness of each damper element is equal to at least 2 mm, over a large part of the length of the element.

In order to provide the best possible damping capabilities, each vibration damper element is located at a vibration antinode.

Since a board will bear on the snow successively via its two lower ridges, depending on whether a turn is being made to the right or to the left, the board according to the invention advantageously has vibration damper elements on both of its sides.

The vibration damper elements arranged on the two sides of the board may be symmetrical with respect to its longitudinal mid-plane or asymmetric with respect to its longitudinal mid-plane, this asymmetry resulting from their respective positioning and/or nature and/or shapes or dimensions.

According to one embodiment of this board, each damper element is centered on one of the following two regions lying at respective distances of between 10 and 20%, and 70 and 90% of the supporting length of the board, taken from its heel.

Advantageously, a damper element is centered in a region lying at a distance of between 75 and 80%, preferably 77%, of the supporting length of the board, taken from its heel.

Further, the constituent material of the damper elements is selected from rubber, polyurethane, EPDM (ethylene propylene diene monomer), ABS (acrylonitrile butadiene styrene) or other styrene derivatives.

BRIEF DESCRIPTION OF THE DRAWINGS

In any case, the invention will be clearly understood from the following description, with reference to the schematic drawing which, by way of nonlimiting examples, represents several embodiments of a board which is illustrated in the case of an alpine ski.

DESCRIPTION OF THE PREFERRED EMBODIMENTS

Figure 1:
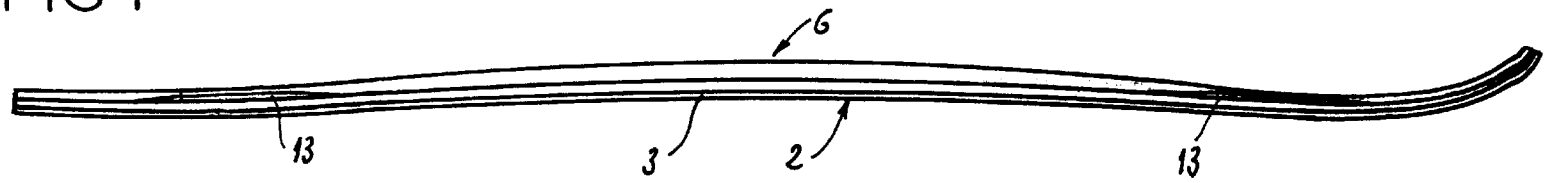
FIG. 1 is a side view of a first ski.
Figure 2:
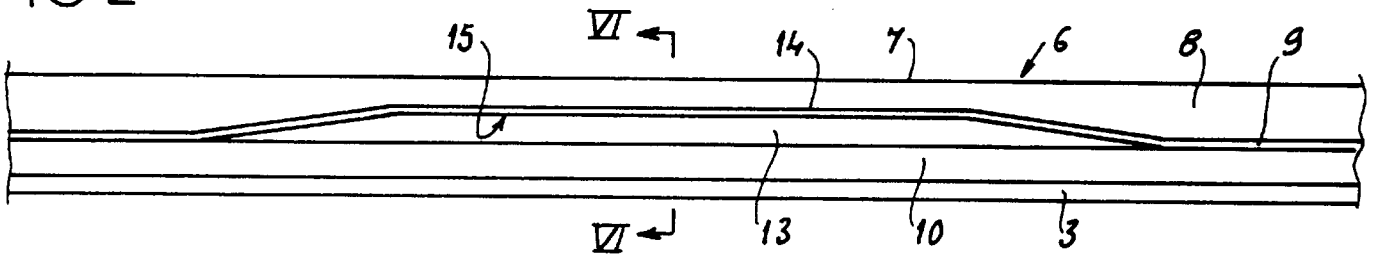
FIG. 2 is a partial view, from the side and on an enlarged scale, of the ski in FIG. 1.
Figure 6:
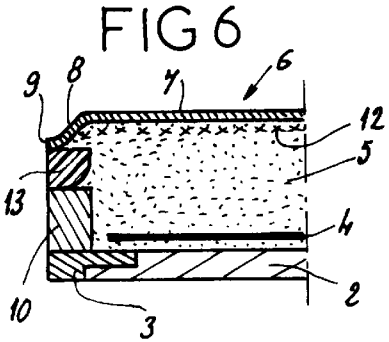

The ski represented in FIGS. 1, 2 and 6 has a lower assembly which consists of a sole 2 bordered by two longitudinal metal edges 3 and is combined with a reinforcing metal strip 4. A central core 5 made of synthetic foam rests on the lower assembly. This ski also has an upper cover 6 forming a shell which consists of an upper wall 7 and is extended laterally by side walls 8 whose lower corners 9, which are slightly turned outward, bear for their most part on two longitudinal reinforcement elements 10, themselves bearing on the edges 3. The upper cover 6 is combined on its inner face with a reinforcing layer 12 consisting, for example, of a fabric impregnated with resin.

According to the essential feature of the invention, this ski is equipped with four damper elements, arranged pairwise symmetrically with respect to the longitudinal mid-plate of the ski. These damper elements, which are made of viscoelastic material, have a length of between 50 and 300 mm, and are each centered on one of the following two regions lying at respective distances of between 10 and 20%, and 70 and 90% of the supporting length of the ski taken from its heel.

In the embodiment represented in FIGS. 1, 2 and 6, each damper element 13 is arranged between a lower corner 9 of the upper cover 6 and a longitudinal reinforcement element 10. The upper cover has, level with a damper element 13, an upward protrusion 14 delimiting a recess 15 intended to accommodate this damper element. As shown in the drawing, the damper element has a height that varies over its length, this height being a maximum in the central part of the element and decreasing in the direction of its ends. The thickness of each damper element is equal to at least 2 mm, over the majority of its length.

In the other embodiments which will be described below, the same elements are denoted by the same references as before.

Figure 3:
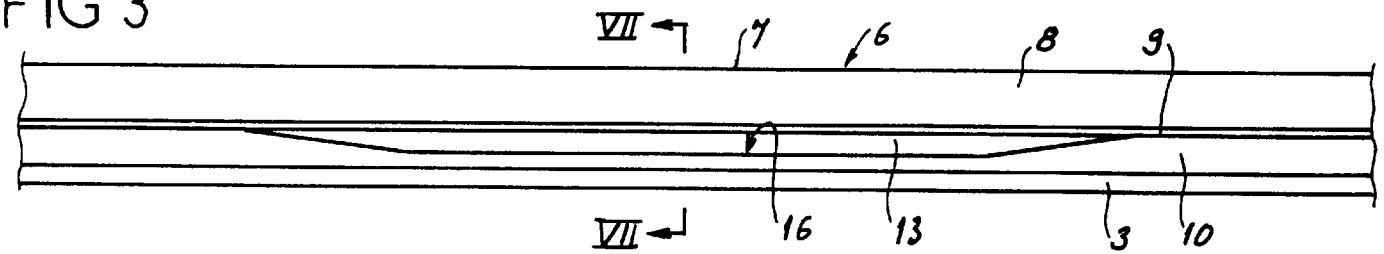
FIGS. 3 to 5 are three views similar to FIG. 2 of three other embodiments of a ski according to the invention.
Figure 7:
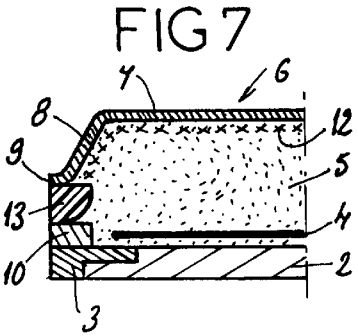

In the embodiment represented in FIGS. 3 and 7, the damper element 13 is still arranged between a lower corner 9 of the upper cover 6 and a reinforcement element 10. In this case, the reinforcement element has a recess 16 which is open upward and emerges in one side of the board, and is intended to accommodate the damper element.

Figure 4:
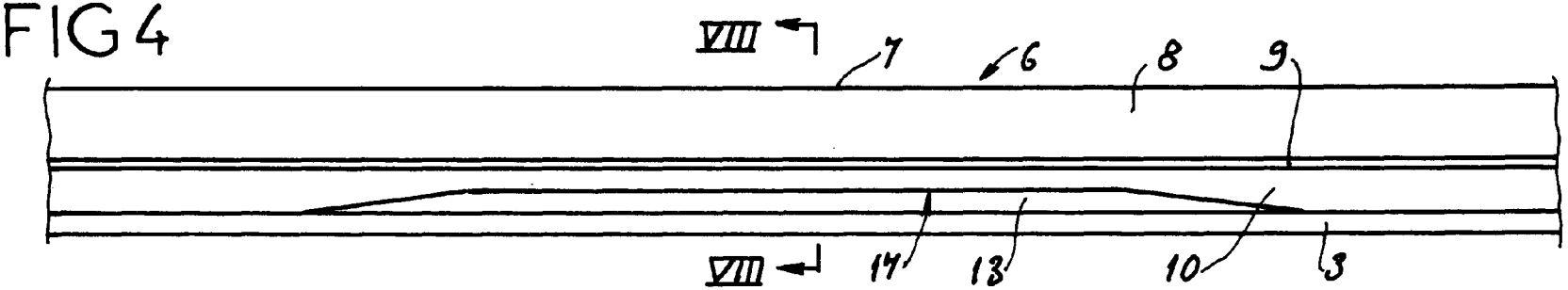
Figure 8:
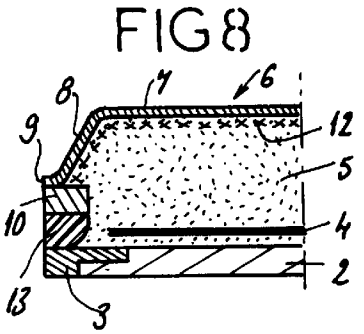

In the embodiment represented in FIGS. 4 and 8, the damper element is arranged between a lower corner of a longitudinal reinforcement element 10 and a metal edge 3 of the ski. In order to make it possible to accommodate the damper element 13, the longitudinal reinforcement element 10 has a recess 17 which is open downward and emerges laterally in one side of the board.

Figure 5:
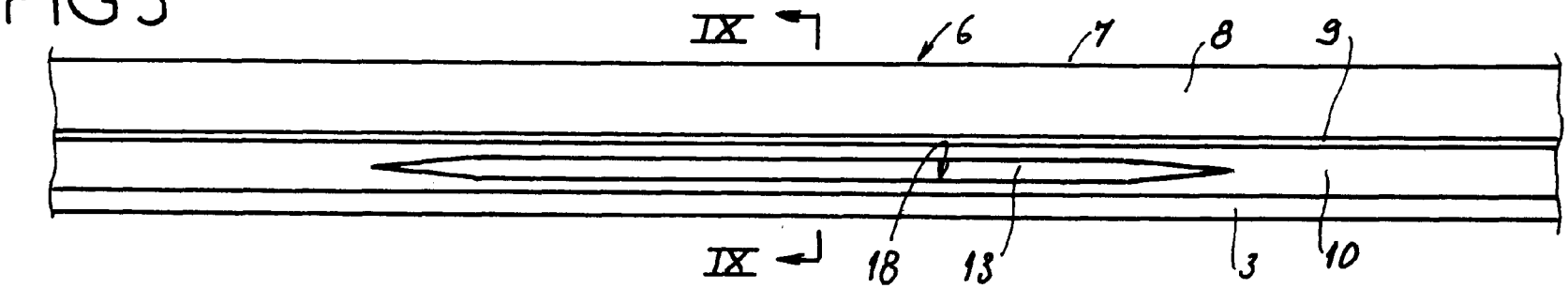
Figure 9:
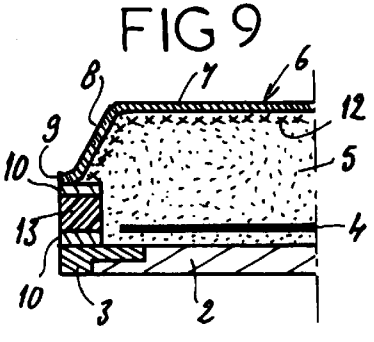
FIGS. 6 to 9 are four views representing half cross sections respectively on the lines VI—VI, VII—VII, VIII—VIII and IX—IX in FIGS. 2, 3, 4 and 5.

In the embodiment represented in FIGS. 5 and 9, a damper element 13 is arranged inside a longitudinal reinforcement element 10, while emerging in one side of the board. In this embodiment, the damper element is accommodated in a slot 18 made in the longitudinal element 10, over its entire width.

Figure 10:
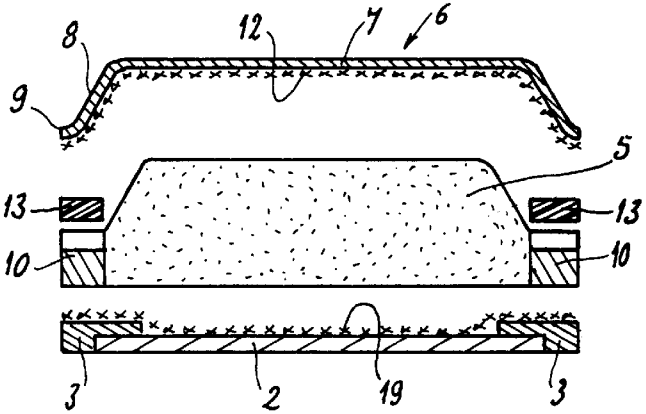
FIG. 10 is an exploded cross-sectional view of a variant of a ski according to the invention in a region corresponding to the section VII—VII.

The embodiment represented in FIG. 10 represents, in exploded view, an embodiment identical to the one represented in FIGS. 3 and 7, but in which the metal reinforcement 4 is replaced by a fabric 19 impregnated with resin forming a lower reinforcement, which rests on the upper face of the sole 2 and the edges 3.

As is self-evident, the invention is not limited just to the embodiments of this gliding board which is described above by way of example in the context of an alpine ski, but instead encompasses all alternative embodiments. Thus, in particular, the number and position of the damper elements could be different, they could be arranged asymmetrically on the two sides of the ski, the shape or the dimensions of the damper elements could vary or, alternatively, the damper element could be accommodated in the thickness of a longitudinal reinforcement element consisting of two superimposed pieces having recesses facing one another to delimit a housing for this damper element.

What is claimed is:

1. A board for gliding on snow, comprising:

a lower assembly composed of a sole;

an upper cover forming a shell composed of an upper wall extended laterally by side walls having lower corners, the lower comers bearing on the lower assembly; and at least one vibration damper element located and emerging visibly on one side of the board, the at least one vibration damper element lying in a region contained between one of the lower comers of the upper cover and the lower assembly, the at least one damper element constituting a direct barrier to vibrations propagating between a lower ridge of the board in contact with snow and the upper wall of the board to which a user's feet are fixed.

2. The board of claim 1, further comprising:

a central core with at least one reinforcement element that bears on the lower assembly, the one of the lower corners of the upper cover bearing on the at least one reinforcement element.

3. The board of claim 2, wherein the damper element is arranged between the one of the lower comers of the upper cover and the reinforcement element.

4. The board of claim 2, wherein the upper cover has, level with the damper element, an upward protrusion delimiting a recess for at least partial accommodation of the damper element.

5. The board of claim 2, wherein each longitudinal reinforcement element has, level with the damper element, a recess which is turned upward and emerges on one side of the board, and is intended for at least partial accommodation of the damper element.

6. The board of claim 2, wherein the damper element is arranged between a lower comer of the longitudinal reinforcement element and the lower assembly, the reinforcement element having a recess emerging in its lower face and on one side of the board, and intended for accommodation of the damper element.

7. The board of claim 2, wherein the damper element is arranged inside the longitudinal reinforcement element in a slot passing through an entire width of the reinforcement element.

8. The board of claim 1, wherein the damper element has a length of between 50 and 300 mm.

9. The board of claim 1, wherein the damper element has a thickness which varies over its length.

10. The board of claim 9, wherein the thickness of the damper element is a maximum in its central part and decreases in the direction of its ends.

11. The board of claim 1, wherein the thickness of the damper element is equal to at least 2 mm, over a large part of the length of the element.

12. The board of claim 1, wherein the damper element is located at a vibration antinode.

13. The board of claim 1, which has vibration damper elements on both of its sides.

14. The board of claim 13, wherein the vibration damper elements arranged on the two sides of the board are symmetrical with respect to its longitudinal mid-plane.

15. The board of claim 13, wherein the vibration damper elements arranged on the two sides of the board are asymmetric with respect to its longitudinal mid-plane, the asymettry resulting from at least one of their respective positioning, nature, shapes and dimensions.

16. The board of claim 1, wherein the damper element is centered on one of the following two regions lying at respective distances of between 10 and 20%, and 70 and 90% of the supporting length of the board, taken from its heel.

17. The board of claim 16, wherein the damper element is centered in a region lying at a distance of between 75 and 80% of the supporting length of the board, taken from its heel.

18. The board of claim 16, wherein the damper element is centered in a region lying at a distance of about 77% of the supporting length of the board, taken from its heel.

19. The board of claim 1, wherein the constituent material of the damper element is selected from rubber, polyurethane, EPDM (ethylene propylene diene monomer), ABS (acrylonitrile butadiene styrene) and a styrene derivative.

* * * * *